US011247491B2

(12) United States Patent
Park et al.

(10) Patent No.: US 11,247,491 B2
(45) Date of Patent: Feb. 15, 2022

(54) PRINTER

(71) Applicant: MANGOSLAB CO., LTD., Seongnam-si (KR)

(72) Inventors: Yong Shik Park, Seongnam-si (KR); Yong Soo Jeong, Seongnam-si (KR)

(73) Assignee: MANGOSLAB CO., LTD., Seongnam-si (KR)

( * ) Notice: Subject to any disclaimer, the term of this patent is extended or adjusted under 35 U.S.C. 154(b) by 0 days.

(21) Appl. No.: 16/301,951

(22) PCT Filed: Nov. 14, 2018

(86) PCT No.: PCT/KR2018/013942
§ 371 (c)(1),
(2) Date: Jun. 27, 2019

(87) PCT Pub. No.: WO2020/101066
PCT Pub. Date: May 22, 2020

(65) Prior Publication Data

US 2021/0268810 A1 Sep. 2, 2021

(30) Foreign Application Priority Data

Nov. 14, 2018 (KR) ..... 10-2018-0140283

(51) Int. Cl.
*B41J 11/00* (2006.01)
*B41J 15/04* (2006.01)

(52) U.S. Cl.
CPC ..... *B41J 11/0005* (2013.01); *B41J 15/044* (2013.01)

(58) Field of Classification Search
CPC .... B41J 11/0005; B41J 15/044; B41J 15/046; G03G 15/6576
See application file for complete search history.

(56) References Cited

U.S. PATENT DOCUMENTS

2008/0252000 A1 10/2008 Dochi
2009/0190985 A1 7/2009 Yamamoto et al.

FOREIGN PATENT DOCUMENTS

| | | |
|---|---|---|
| EP | 1 303 413 B1 | 4/2003 |
| JP | 5292834 B2 | 9/2013 |
| KR | 20-1999-0030942 | 7/1999 |
| KR | 10-2007-0077776 | 7/2007 |
| KR | 10-1712404 | 3/2017 |

*Primary Examiner* — Lamson D Nguyen
(74) *Attorney, Agent, or Firm* — Foley & Lardner LLP

(57) ABSTRACT

The present disclosure relates to a printer for pulling out a paper wound in the form of a wound roll, and more particularly, to a printer which includes a cartridge configured to accommodate the paper, a housing in which the cartridge is mounted, and a printing part configured to pull out the paper. The cartridge or the housing has a decurling part formed thereon, and the decurling part comes into surface-contact with the paper on the upper side of the paper in the process of pulling out the paper.

19 Claims, 12 Drawing Sheets

<a>

<a>

PRINTER

CROSS-REFERENCE TO RELATED APPLICATION

This application claims priority to and the benefit of Korean Patent Application No. 10-2018-0140283, filed on Nov. 14, 2018, the disclosure of which is incorporated herein by reference in its entirety.

BACKGROUND

1. Field of the Invention

The present invention relates to a printer, and more particularly, to a printer capable of preventing a paper from being pulled out in a curled state by decurling the paper in the process of pulling out the wound paper.

2. Discussion of Related Art

Generally, printers are devices configured to receive electric signals or the like to print a paper which is accommodated in the printers. Due to the miniaturization of printers, printers pull out a paper wound in the form of a roll to print the paper. In particular, printers are frequently used in commercial shops, where receipts, recording papers, or the like are used. Printers may also be used for printing photographed pictures in a short time with the development of image-capturing devices such as digital cameras, or the like. Therefore, printers are expected to be used in many fields in the future (for example, as a portable printer or the like). Such printers perform a printing operation using a method such as driving a printing unit to transfer ink on a paper while pulling out the wound roll-shaped paper. However, in a conventional printer, even after a wound roll-shaped paper is pulled out, the paper is kept in the roll shape and curled in a roll direction (i.e., a curl direction or a direction to a center of the roll), and thus handling of the pulled-out paper may be cumbersome.

In order to solve such problems, some printers according to the prior art may prevent a curling phenomenon. To prevent the curling phenomenon, a paper being pulled out is bended in a direction opposite to a roll (that is, in a decurl direction or in a direction opposite to a center of the roll) by a roller-shaped correcting device, which is provided in the printer. However, such printers have a problem in that the size of the printers increases due to a separate space for accommodating the roller-shaped correcting device. Further, when correcting the paper using heat, the paper may be damaged, or the curl may not be corrected when thermal energy applied to the paper from a heat source is not uniform during the correction process. Furthermore, the heat generated from the heat source may cause a thermal change of internal components of the printer, and thus a solution is needed.

PRIOR ART DOCUMENTS

Patent Documents

Prior art document 1: Korean Patent Application Publication No. 10-2007-0077776 (published on Jul. 27, 2007)

Prior art document 2: Korean Utility Model Application Publication No. 20-1999-0030942 (published on Jul. 26, 1999)

SUMMARY OF THE INVENTION

An objective of the present invention is to provide a device capable of decurling a paper without requiring an additional correcting device.

Another objective of the present invention is to provide a device capable of preventing a paper and ink on the paper from being altered in the process of pulling out the paper.

Still another objective of the present invention is to provide a device capable of decurling a paper with a uniform force so as to prevent the pulled-out paper from being curled.

Yet another objective of the present invention is to provide a device capable of decurling a paper with a uniform force so as to have the pulled-out paper in a flat state.

Still yet another objective of the present invention is to provide a device capable of decurling various types of paper by merely exchanging a cartridge without separate structural modification.

Still yet another objective of the present invention is to provide a device capable of exchanging a worn-out decurling part by merely exchanging a cartridge without separate structural modification.

One aspect of the present invention provides a printer for pulling out a paper wound in the form of a wound roll including a cartridge configured to accommodate the paper, a housing in which the cartridge is mounted, and a printing part configured to pull out the paper. The cartridge or the housing has a decurling part formed thereon, and the decurling part comes into surface-contact with the paper on the upper side of the paper in the process of pulling out the paper Another aspect of the present invention provides a printer for pulling out a paper wound in the form of a wound roll including a cartridge configured to accommodate the paper, a housing in which the cartridge is mounted, and a printing part configured to pull out the paper. The cartridge has a decurling part formed thereon, and the decurling part comes into surface-contact with the paper on the upper side of the paper in the process of pulling out the paper.

Another aspect of the present invention provides a printer for pulling out a paper wound in the form of a wound roll including a cartridge configured to accommodate the paper, a housing in which the cartridge is mounted, and a printing part configured to pull out the paper. The housing includes a cover configured to open and close an upper surface of the housing. The cover has a decurling part formed thereon, and the decurling part comes into surface-contact with the paper on the upper side of the paper in the process of pulling out the paper when the cover closes the upper surface of the housing.

In the printer according to an embodiment of the present invention, the housing has a first guide part and a second guide part formed thereon, and the first guide part and the second guide part come into surface-contact with the paper on the lower side of the paper in the process of pulling out the paper.

In the printer according to an embodiment of the present invention, the first guide part and the second guide part are formed to have a step with respect to each other, and the decurling part is positioned in a space formed by the step between the first guide part and the second guide part when the cartridge is mounted in the housing.

In the printer according to an embodiment of the present invention, the housing has a first guide part and a second guide part formed thereon, and the first guide part and the second guide part come into surface-contact with the paper on the lower side of the paper in the process of pulling out the paper.

In the printer according to an embodiment of the present invention, the first guide part and the second guide part are formed to have a step with respect to each other, and the decurling part is positioned in a space formed by the step between the first guide part and the second guide part when the cover closes the upper surface of the housing.

In the printer according to an embodiment of the present invention, the decurling part includes a detachable thickness adjusting part such that a pressure of the decurling part against to the paper is adjusted by modifying a thickness of the decurling part.

In the printer according to an embodiment of the present invention, at least one of the first guide part, the second guide part, or the decurling part has a corner in contact with the paper, and the corner has a curvature radius.

In the printer according to an embodiment of the present invention, the first guide part, the second guide part, and the decurling part have corners in surface-contact with the paper, and the curvature radius of the corner of the decurling part is smaller than the curvature radius of corners of the first guide part and the second guide part.

In the printer according to an embodiment of the present invention, the first guide part, the second guide part, and the decurling part have corners in surface-contact with the paper, and the corners of the first guide part and the second guide part have a curvature radius, and the corner of the decurling part has a right angle.

In the printer according to an embodiment of the present invention, the printing part pulls out the paper so that the paper is bent at the second guide part with an included angle of 120 degrees or more.

According to the present invention, a separate roller for decurling a paper can be omitted, and thus a size of a printer can be reduced.

According to the present invention, it is possible to prevent a paper from deforming due to excessive force and heat in the process of decurling the paper, thereby improving the quality of the paper.

According to the present invention, a pressure on the paper can be adjusted according to a thickness of a paper, and thus it is possible to decurl various types of paper having different thicknesses.

According to the present invention, it is possible to decurl various types of paper merely by exchanging a cartridge without separate structural modification According to the present invention, it is possible to exchange the worn-out decurling part by merely exchanging a cartridge without separate structural modification.

DETAILED DESCRIPTION OF EXEMPLARY EMBODIMENTS

Figure 1:
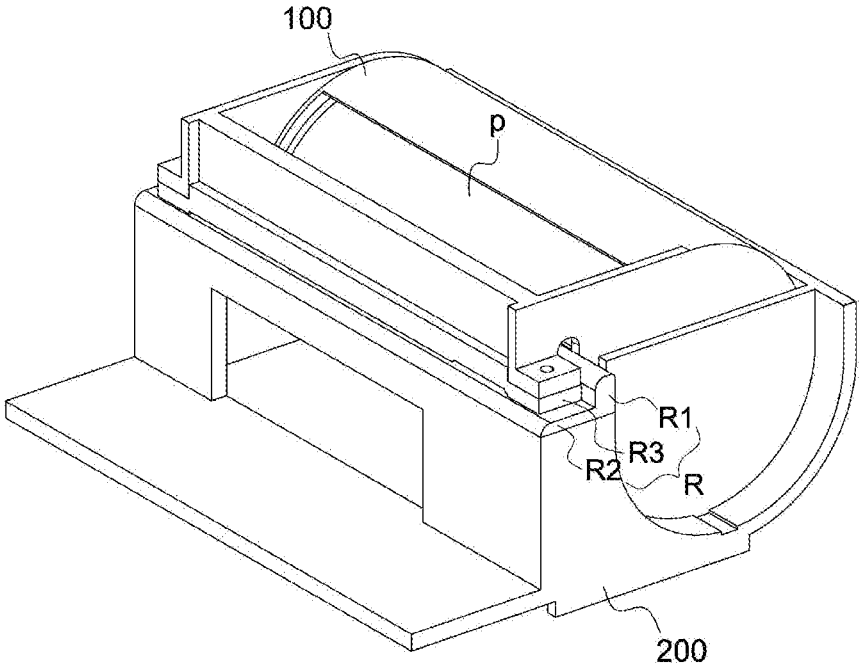
FIG. 1 is a perspective view illustrating a printer according to a first embodiment of the present invention.

Hereinafter, embodiments of the present invention will be described in detail with reference to the accompanying drawings so that those of ordinary skill in the art can easily implement them. However, the present invention may be implemented in various forms and is not limited to the embodiments described below. Further, portions irrelevant to the present invention are omitted in the drawings in order to clearly explain the present invention, and the same or similar reference numerals in the drawings denote the same or similar components.

The objects and effects of the present invention can be naturally understood or become more apparent due to the following description, and the objects and effects of the present invention are not limited only to the following description.

The above and other objects, features, and advantages of the present invention will become more apparent through the following detailed description. When it is determined that detailed descriptions of related well-known functions unnecessarily obscure the gist of the present invention during the description of the present invention, the detailed descriptions will be omitted.

Prior to describing the present invention in detail, unless otherwise stated, an "upper side" refers to a side over an upper surface or an outer surface of the paper being transported while the roll-shaped paper accommodated in a cartridge of a printer is being pulled out. A "lower side" refers to a side under a bottom surface or an inner surface of the paper being transported while the roll-shaped paper accommodated in the cartridge of a printer is being pulled out.

Figure 6:
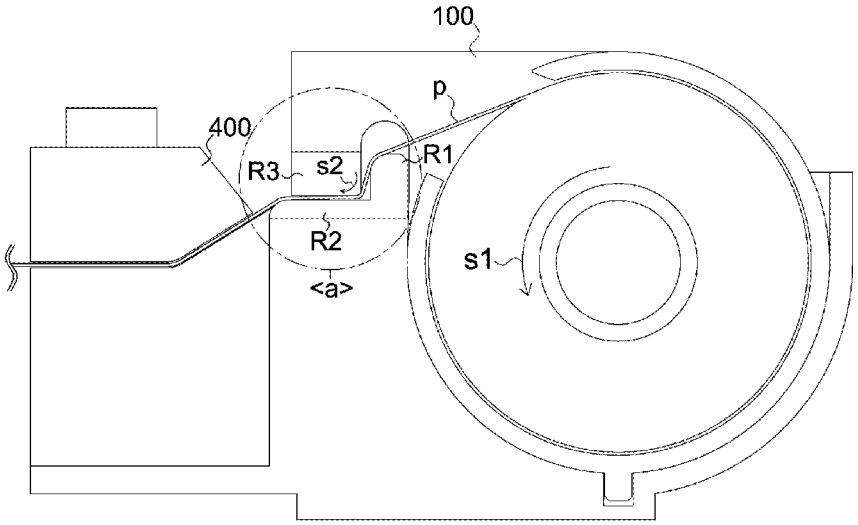
FIG. 6 is a cross-sectional view of the printer according to the first embodiment of the present invention.

A "curl direction" refers to an outward direction on the basis of a paper p being curled like a reference numeral "s1" in FIG. 6. A "decurl direction" refers to an outward direction on the basis of the paper p being curled like a reference numeral "s2" in FIG. 6. A "decurl" refers to flattening the paper p curled in the curl direction of the roll shape of the accommodated paper.

Figure 5:
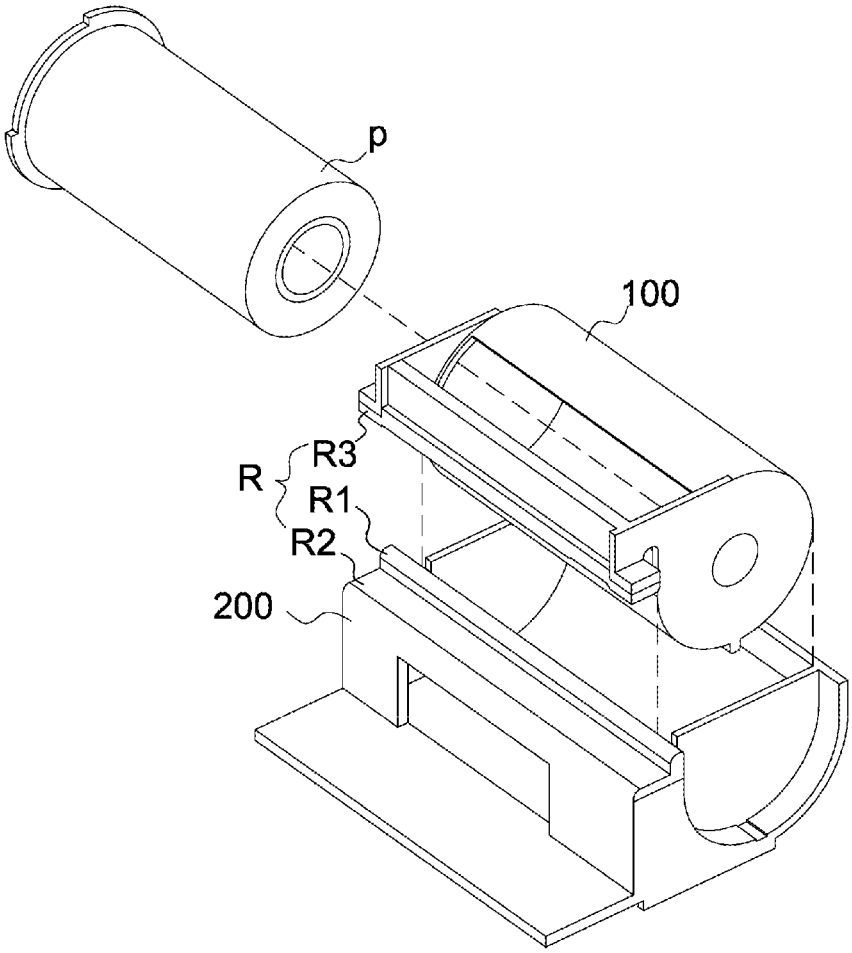
FIG. 5 is an exploded perspective view illustrating the printer according to the first embodiment of the present invention.

"One direction" refers to a direction in which the paper accommodated in the cartridge is pulled out, for example, in a lower leftward direction in FIG. 1 and a leftward direction in FIG. 5.

Hereinafter, embodiments of the present invention will be described in detail with reference to the attached drawings.

FIG. 1 is a perspective view illustrating a printer according to a first embodiment of the present invention.

The printer according to the present invention includes a cartridge 100 configured to accommodate a paper p, a housing 200 in which the cartridge 100 is mounted, and a printing part 400 (see FIG. 6) configured to print and pull out the paper p. A contact part R is formed on the cartridge 100 and/or the housing 200. The contact part R comes into surface-contact with the paper p on upper and lower sides of the paper p in a process in which the paper p passes through the cartridge 100 and the housing 200 and is pulled out.

The paper p may be wound in the form of a roll and accommodated in the cartridge 100. The accommodated paper p may be printed by a thermal head (not shown) of the printing part 400 and pulled out in one direction by a feed roller (not shown) of the printing part 400.

The contact part R may prevent the paper p from being rewound by performing the decurling operation while the paper p accommodated in the cartridge 100 is pulled out. The contact part R may include a first guide part R1, a second guide part R2, and a decurling part R3. The decurling part R3 comes into surface-contact with the paper p on an upper side of the paper in a decurl direction so that the pulled-out paper p is prevented from being rewound. At this time, the first and second guide parts R1 and R2 may come into surface-contact with the paper p to support a pressure applied to the paper p by the decurling part R3.

Figure 2:
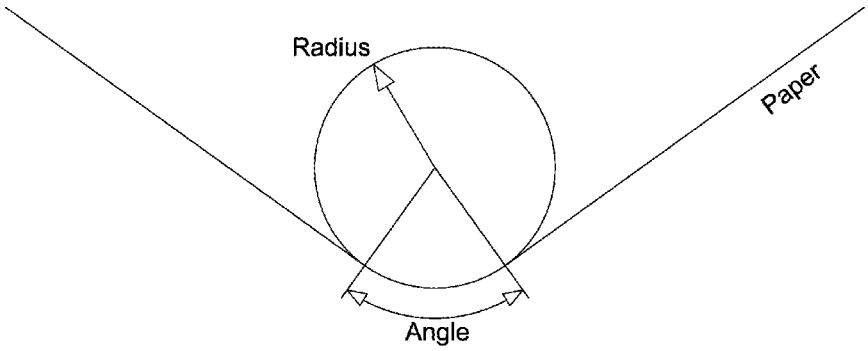
FIG. 2 is a view illustrating a decurling part, which is configured to decurl a paper, and elements for decurling the paper.
Figure 3:
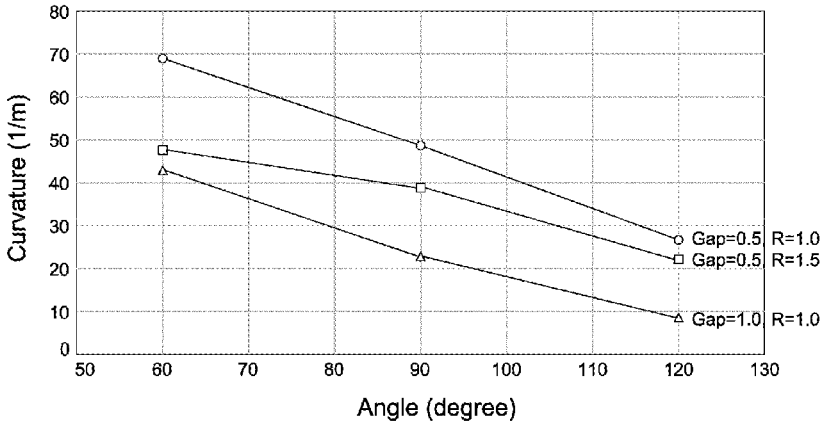
FIG. 3 is a graph illustrating a correlation between the elements for decurling the paper.
Figure 4:
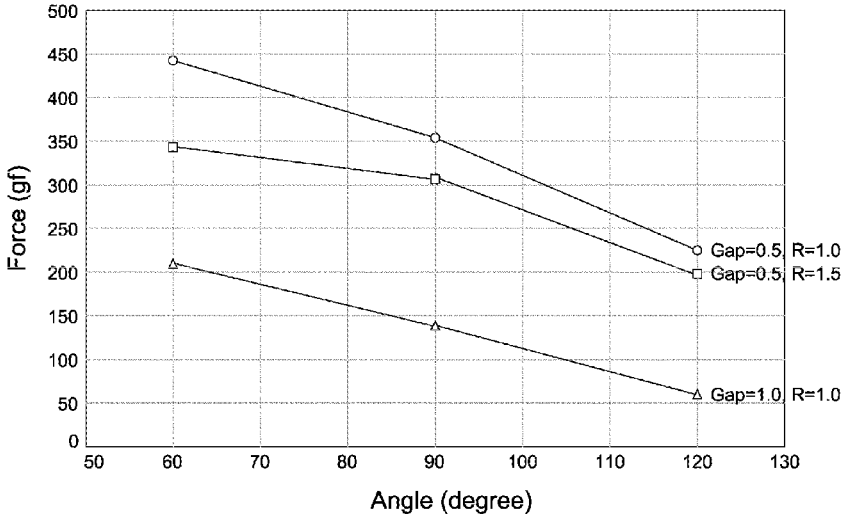
FIG. 4 is another graph illustrating the correlation between the elements for decurling the paper.

FIG. 2 is a view illustrating a decurling part configured to decurl the paper, the paper in surface-contact with the decurling part, a curvature radius R of the decurling part, and an angle at which the paper is bent by the decurling part. In FIG. 2, the decurling part is shown in the form of a roller to show the curvature radius of a contact surface of the decurling part, but this is for convenience of understanding and is not a form of the actual decurling part. FIG. 3 is a graph illustrating a degree of curvature (unit: l/m) of the paper according to a contact angle (unit: degree) at which the decurling part comes into contact with the paper, a radius R (unit: mm) of a curved surface of the decurling part, and a size (unit: mm) of a gap of a transport path of the paper. Here, the curvature is a value indicating a degree of curling of the paper, and the higher the value, the flatter the paper is. FIG. 4 is a graph illustrating a change in force required to decurl the paper according to the contact angle (unit: degree) at which the decurling part comes into contact with the paper, the radius R (unit: mm) of the curved surface of the decurling part, and the size (unit: mm) of the gap of the transport path of the paper. Here, in FIGS. 3 and 4, the size of the gap of the transport path of the paper corresponds to a distance between the decurling part and a structure facing the decurling part when a space for the paper to be transported is formed between the decurling part and the structure facing the decurling part.

Elements for decurling the paper will be described with reference to FIGS. 2 to 4.

While the roll-shaped paper accommodated in the cartridge of the printer is being pulled out, the decurling part comes into surface-contact with the paper and applies force to the paper in a direction opposite to a curl of the roll (i.e., the decurl direction). Here, the contact angle (refer to a reference label "Angle" in FIG. 2) is formed when the decurling part comes into surface-contact with the paper. The contact angle is a degree at which the paper is bent, which affects the curvature of the paper (i.e., a degree at which the paper is decurled). Further, the radius of the decurling part which comes into surface-contact with the paper also affects the curvature of the paper. The size of the gap of the path through which the paper is transported also affects the curvature of the paper.

When the contact angle between the paper and the decurling part is excessively great, the force required to decurl the paper is small (see FIG. 4), but the paper may be deformed, for example, a line-shaped mark may be formed on the paper. Further, the smaller the curvature radius R of the curved surface of the decurling part is, the greater a driving force required for decurling (see FIG. 4) is and abrasion of the decurling part increases, but the effect of the decurling increases (see FIG. 3). Accordingly, it is necessary to reduce the curvature radius of the decurling part, but when the decurling part is implemented as a separate roller, there is a limit in reducing the curvature radius, replacement of the roller is not easy, and a unit price increases. Further, a size of the printer also increases.

On the other hand, when the decurling part is formed on the cartridge or the housing as in the present invention, manufacturing costs and a size of the printer may be reduced while reducing the curvature radius. Particularly, when the decurling part is formed on the cartridge, a worn-out decurling part may be easily replaced. Furthermore, even when an internal structure of the printer is not modified, the decurling part may be easily replaced according to a thickness of the paper or a type of the paper through the replacement of the cartridge.

Further, when the size (unit: mm) of the gap of the path through which the paper is transported is adjusted according to the thickness of the paper or the type of the paper as in the present invention, the paper may be more effectively decurled.

FIG. 5 is an exploded perspective view illustrating the printer according to the first embodiment of the present invention.

The printer according to the present invention includes the cartridge 100 and the housing 200. The contact part R is formed on the cartridge 100 and/or the housing 200. The contact part R may include the first guide part R1, the second guide part R2, and the decurling part R3.

The cartridge 100 is a structure which accommodates the paper p. Specifically, there is a space formed in the cartridge 100 for accommodating the paper p wound in the form of the roll, and to this end, the cartridge 100 has a cylindrical shape in which sides thereof are open. Further, the cartridge 100 is mounted in the housing 200. For example, the cartridge 100 may be provided with a separate protrusion for coupling with the housing 200, and the protrusion may prevent in advance the cartridge 100 from being separated from the housing 200 by an external force after the cartridge 100 is mounted in the housing 200. The cartridge 100 is mounted in the housing 200 while accommodating the paper p therein and may continuously supply the paper p to a printing part. The decurling part R3 is formed on the cartridge 100.

The cartridge 100 is mounted in the housing 200. To this end, an upper surface of the housing 200 may be opened corresponding to a shape of the cartridge 100 having a cylindrical shape. Further, an insertion groove corresponding to the separate protrusion formed on the cartridge 100 may be further provided in the housing 200 for more firm coupling with the cartridge 100. Accordingly, the housing 200 may constantly fasten up the cartridge 100 in a state in which the cartridge 100 is accommodated. The first and second guide parts R1 and R2 may be formed on the housing 200.

The printing part 400 prints the paper p supplied from the cartridge 100 mounted in the housing 200 (see FIG. 6). For example, the printing part 400 includes a pair of body parts spaced apart from each other by a certain distance in upward and downward directions and passes the paper p between the pair of body parts to print the paper p. As one example, the printing part 400 may further include the thermal head positioned on the transport path of the paper p in the one direction and the feed roller configured to pull the paper p out in the one direction. The thermal head may come into contact with the paper p and apply heat to perform printing by selectively heating a plurality of separately provided heating elements. The feed roller may transport the paper p in the one direction and pull the paper p out in the one direction of the printing part 400. Through the above-described series of configurations, the printing part 400 may easily print the paper p supplied from the cartridge 100 and pull the paper p out in the one direction.

The contact part R may prevent the paper p from being rewound by performing the decurling operation while the paper p accommodated in the cartridge 100 is pulled out. To this end, the contact part R includes the first guide part R1, the second guide part R2, and the decurling part R3.

FIG. 6 is a cross-sectional view of the printer according to the first embodiment of the present invention.

The paper p accommodated in the cartridge 100 mounted in the housing 200 passes through the cartridge 100 and the housing 200, and in this process, the paper p is decurled by the contact part R.

The contact part R includes the first guide part R1, the second guide part R2, and the decurling part R3. The decurling part R3 comes into surface-contact with the paper p on the upper side of the paper in the decurl direction so that the pulled-out paper p is prevented from being rewound. At this time, the first and second guide parts R1 and R2 may come into surface-contact with the paper p to support the pressure applied to the paper p by the decurling part R3.

According to the first embodiment, the first and second guide parts R1 and R2 are formed on the housing 200, and the decurling part R3 is formed on the cartridge 100. For example, the first guide part R1 and second guide part R2 may be formed to have a step with respect to each other. In FIG. 6, the first guide part R1 and the second guide part R2 are shown to form an angle of 90 degrees, but the present invention is not limited thereto.

The decurling part R3 formed on the cartridge may be positioned in a space formed by the step. Accordingly, the space required for decurling the paper p may be minimized while omitting a roller as compared with the related art in which the separate roller is provided. Accordingly, the printer may be easily miniaturized.

For example, at least one of corners of the first guide part R1 or the second guide part R2 may be formed such that a corner which comes into contact with the paper p has a certain curvature radius. A corner of the first guide part R1, which comes into surface-contact with the paper p, may have a first curvature radius R11. Or, a corner of the second guide part R2, which comes into surface-contact with the paper p, may have a second curvature radius R21 (see FIG. 8). The first guide part R1 or the second guide part R2, which respectively have the first curvature radius R11 or the second curvature radius R21, prevents the paper p from being excessively bent while coming into surface-contact with the paper p so that the unnecessary deformation of the paper p may be prevented. Further, a phenomenon in which the paper p is lifted from the first guide part R1 or the second guide part R2 may be prevented as compared with a case in which the corner of the guide part, which comes into contact with the paper p, has a right angle. Therefore, it is possible to transport the paper p more accurately and perform an accurate printing operation. Further, a phenomenon in which the paper p is worn may also be prevented. Both the first guide part R1 and the second guide part R2 may be formed to respectively have the first curvature radius R11 and the second curvature radius R21. Here, prevention of the lifting, the deformation, and the abrasion of the paper p may be more effective.

According to the first embodiment, the decurling part R3 is formed on the cartridge 100. Specifically, when the cartridge 100 is mounted in the housing 200, the decurling part R3 comes into surface-contact with the paper p on the upper side of the paper p, which is being pulled out, in the decurl direction. Accordingly, the decurling part R3 decurls the paper p to suppress a phenomenon in which the paper p is rewound. A corner of the decurling part R3 may apply the pressure to the paper p in the decurl direction to decurl the paper p.

Alternatively, the corner of the decurling part R3, which comes into surface-contact with the upper surface of the paper p, has a third curvature radius R31, and the third curvature radius R31 is formed to be smaller than the first curvature radius R11 and the second curvature radius R21, thereby improving the effect of the decurling.

The corner of the decurling part R3 may have a right angle or the third curvature radius R31 which is smaller than the first curvature radius R11 and the second curvature radius R21, which may be similarly applied to the second and third embodiments of the present invention.

Figure 7:
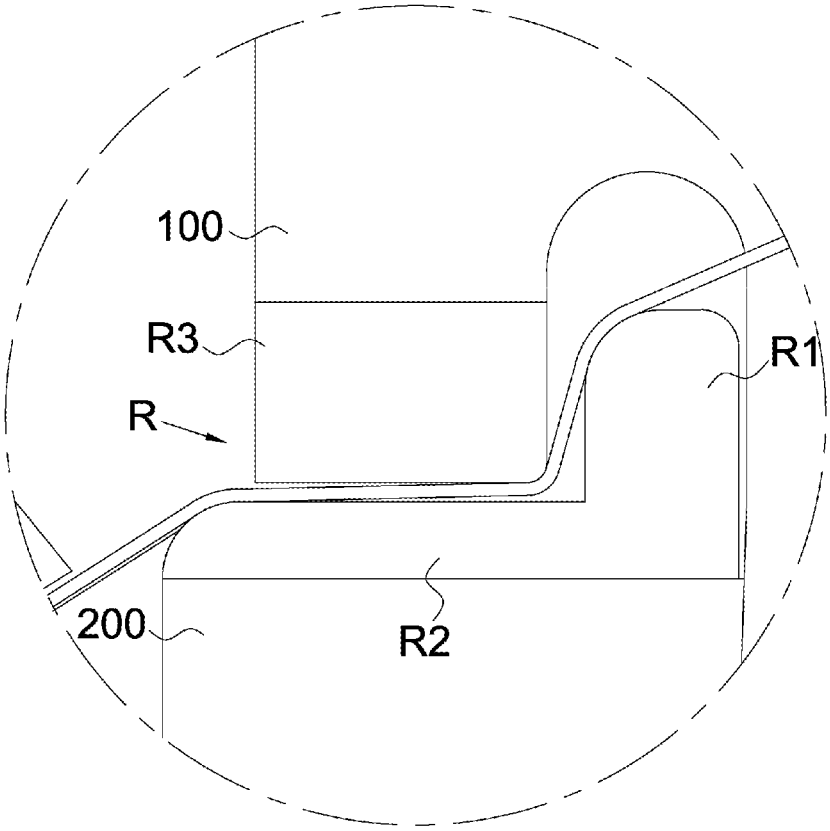
FIG. 7 is an enlarged view of portion <a> in FIG. 6.
Figure 8:
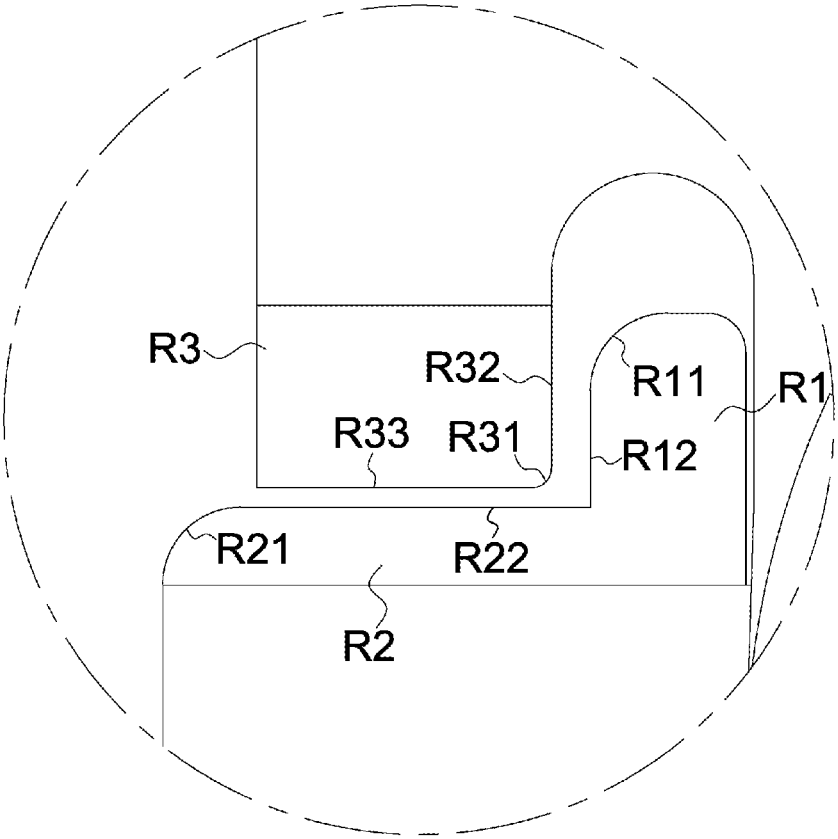
FIG. 8 is a cross-sectional view illustrating a first guide part, a second guide part, and a decurling part according to the first embodiment of the present invention.

Hereinafter, the first guide part R1, the second guide part R2 and the decurling part R3 will be described in more detail with reference to FIGS. 7 and 8.

The first guide part R1 comes into surface-contact with the paper p pulling out from the cartridge 100 and provides the path configured to allow the paper p to be transported to the decurling part R3 therethrough and prevents the paper p from being lifted while the paper p is pulled out. To this end, the first guide part R1 is formed to be perpendicular to the second guide part R2 in FIG. 7, but the present invention is not limited thereto. The first guide part R1 comes into surface-contact with an inner surface or a bottom surface of the paper p in the curl direction, and the paper p is transported toward the decurling part R3 after contacting the first guide part R1. The corner of the first guide part R1, which comes into surface-contact with the paper p, may have a certain first curvature radius R11. The first guide part R1 and the second guide part R2 may be formed to have a step with respect to each other, and a first space part may be formed between a first surface R12 of the first guide part R1 and a third surface R32 of the decurling part R3. As the first space part is provided, the paper p pulling out from the cartridge 100 comes into surface-contact with a corner of the first guide part R1, which has the first curvature radius R11, and then comes into surface-contact with a corner of the decurling part R3, which has the third curvature radius R31.

The decurling part R3 decurls the paper p which has passed through the first guide part R1, and the corner of the decurling part R3, which comes into surface-contact with the paper p, is round processed to have a third curvature radius R31 of a size smaller than the first curvature radius R11 and the second curvature radius R21. The decurling part R3 includes the third surface R32 such that the paper p, which has passed through the first guide part R1, is transported toward the corner having the third curvature radius R31. The third surface R32 is formed to be spaced apart from the first surface R12 of the first guide part R1 by a certain distance.

The third surface R32 and a fourth surface R33 form the corner having the third curvature radius R31. An outer surface of the paper p which has passed through the first guide part R1 comes into surface-contact with the corner having the third curvature radius R31, and the corner having the third curvature radius R31 bends the paper p in the decurl direction so that the paper p is transported toward the second guide part R2 in the state of being decurled.

The second guide part R2 guides the paper p decurled at the decurling part R3 to the printing part 400. To this end, the second guide part R2 may be formed to be perpendicular to the first guide part R1. Accordingly, the first guide part R1 and the second guide part R2 may be formed to have an inverted "L" shape, and a second space part is formed between the decurling part R3 and the second guide part R2. Further, the second guide part R2 includes a second surface R22 connected to the first surface R12 of the first guide part R1. The second surface R22 forms a right angle with the first surface R12 and is formed to be spaced apart from the fourth surface R33 of the decurling part R3 by a certain distance. Here, a distance (hereinafter referred to as a "first distance") between the first surface R12 and the third surface R32 and a distance (hereinafter referred to as a "second distance") between the second surface R22 and the fourth surface R33 may be provided to be the same or different from each other according to the designer's setting. That is, when it is desired to prevent an excessive deformation of the paper p which has passed through the first space part, the first distance and the second distance are increased to reduce the pressure of the decurling part R3. As a more preferred embodiment, the first distance and the second distance may be provided to have a size of 0.1 mm to 3 mm. A corner having the second curvature radius R21 is further provided on the second guide part R2. Specifically, the second surface R22 includes a corner so as to more easily and accurately guide the paper p passing through the second guide part R2 toward the printing part 400, and the corner is round processed to have the second curvature radius R21. Accordingly, through the corner having the second curvature radius R21, the paper p directed toward the printing part 400 may be prevented from being lifted or twisted between the housing 200 and the printing part 400, and a line-shaped mark may be prevented in advance from remaining on the paper p in the process of being transported to the printing part 400, thereby remarkably improving the quality of the finally printed paper p. Alternatively, at least one corner of the first guide part R1, the second guide part R2, or the decurling part R3 may be formed to have the certain curvature radius. Specifically, at least one corner of the first guide part R1, the second guide part R2 or the decurling part R3 may be formed to have the first curvature radius R11, the second curvature radius R21, or the third curvature radius R31, which may be changed by the designer according to the thickness and a material of the paper p so that it is possible to perform optimal decurling with respect to various types of paper p having different thicknesses and materials. This may be similarly applied to the first embodiment and second and third embodiments, which will be described later, of the present invention. In addition, it is preferable that widths of the first guide part R1, the second guide part R2, and the decurling part R3 are formed to be greater than a width of the paper being pulled out in the one direction.

Figure 9:
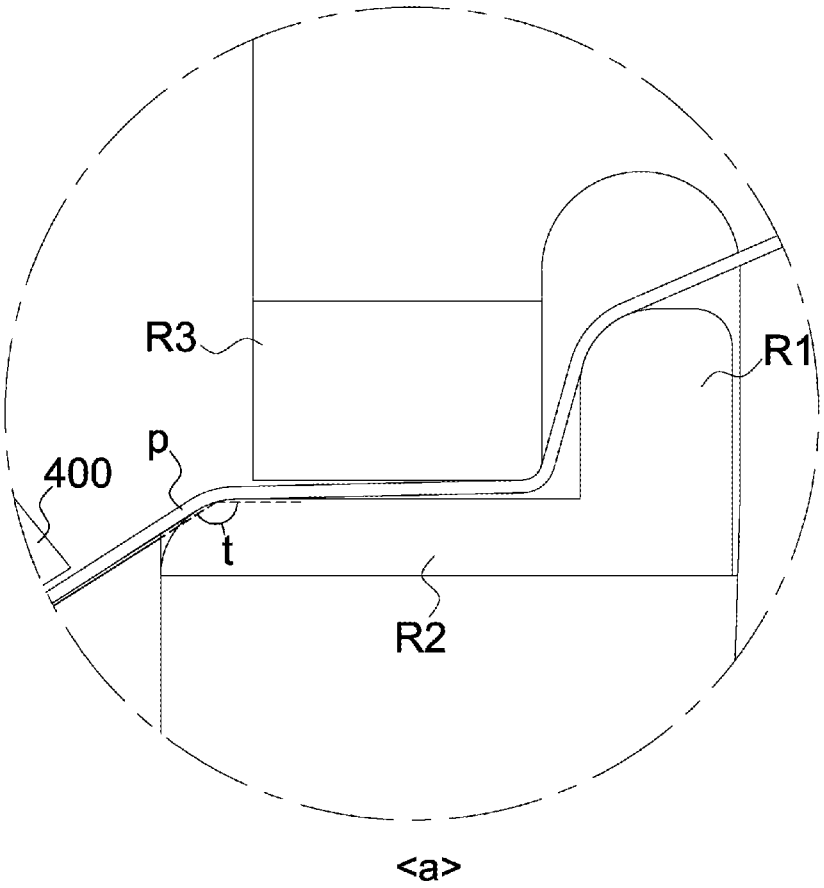
FIG. 9 is a view illustrating an included angle of the paper bent by the second guide part.

FIG. 9 is a view illustrating an included angle of the paper bent by the second guide R2.

The paper p passing through the corner of the second guide part R2, which has the second curvature radius R21, is bent by the surface-contact with the second guide part R2 so as to have an included angle t. Specifically, the paper p before the surface-contact with the second guide part R2 and the paper p after the surface-contact with the second guide part R2 forms the included angle t, which is for the purpose of allowing the paper p to be easily supplied to the printing part 400, and, at the same time, correcting the paper p which is excessively decurled. For example, the included angle t is formed to be 120 degrees or more, and the printing part 400 pulls the paper p passing through the second guide part R2 out so as to have such an included angle t. As a result, the paper p may be prevented from being excessively decurled and being curled in the opposite direction of the curl in the process of being pulled out from the printing part 400.

Figure 10:
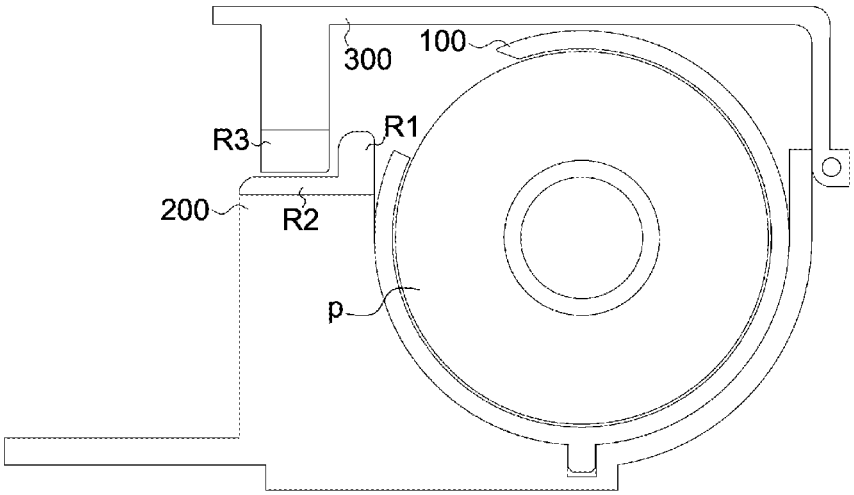
FIG. 10 is a cross-sectional view of a printer according to a second embodiment of the present invention.

FIG. 10 is a cross-sectional view of a printer according to a second embodiment of the present invention.

As compared with the first embodiment, the second embodiment of the present invention further includes a cover 300, and a decurling part R3 is formed in a different position. The cover 300 is configured to open and close an upper surface of a housing 200. To this end, the cover 300 is coupled to the housing 200 by hinge connection using a hinge formed separately. Accordingly, the cover 300 may protect a paper p accommodated in the cartridge 100 from foreign substances such as outside air and dust by opening and closing the upper surface of the housing 200.

A decurling part R3 according to the second embodiment of the present invention is formed on the cover 300. The decurling part R3 is provided to perform the same shape and role as the first embodiment of the present invention. However, the decurling part R3 according to the second embodiment of the present invention is formed on the cover 300 of the housing 200 instead of the cartridge. That is, the decurling part R3 is formed on the cover 300 so as to face a first guide part R1 and a second guide part R2. Thus, when the cover 300 closes an upper surface of the housing 200 through the hinge movement, the decurling part R3 formed on the cover 300 hinge moves integrally with the cover 300 and is positioned above the first and second guide parts R1 and R2, and then the decurling part R3 comes into surface-contact with an outer surface or an upper surface of the paper p while the paper p is pulled out from the cartridge 100, thereby decurling the paper p. Through the above-described series of configurations, when the paper p needs to be decurled, the cover 300 is hinge-moved, when it is necessary, to decurl the paper p.

Figure 11:
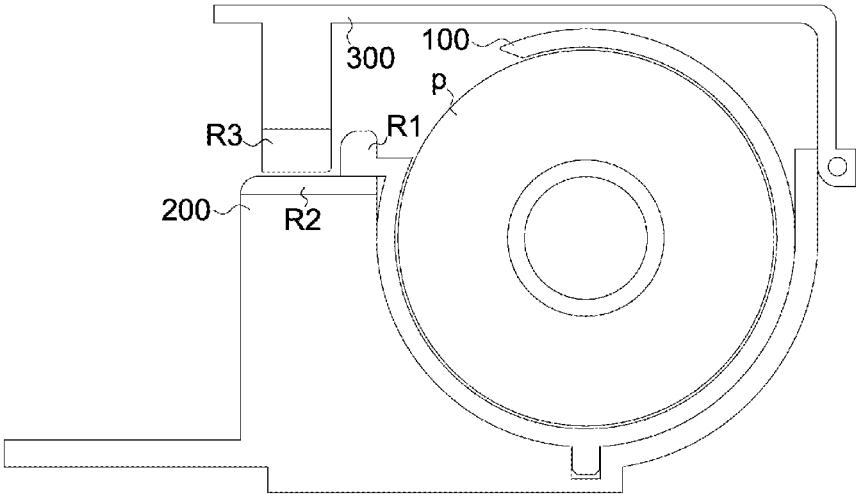
FIG. 11 is a cross-sectional view of a printer according to a third embodiment of the present invention.

FIG. 11 is a cross-sectional view of a printer according to a third embodiment of the present invention.

In the third embodiment of the present invention, a first guide part R1 is in a different position as compared with the second embodiment. The first guide part R1 is formed to have a corner having a first curvature radius R11 as in the first embodiment and protrudes from an outer circumferential surface of a cartridge 100. The first guide part R1 may protrude in an outward direction from an outer circumferential surface of the cartridge 100.

Figure 12:
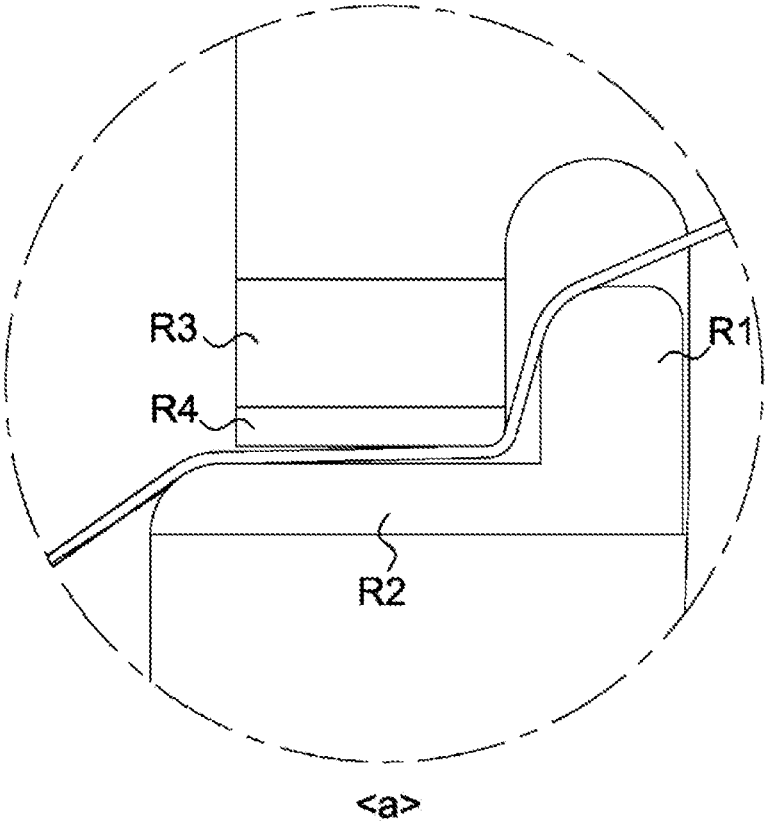
FIG. 12 is a view illustrating a thickness adjusting part according to the present invention.

FIG. 12 is a view illustrating a thickness adjusting part R4 according to the present invention.

The thickness adjusting part R4 may adjust the first distance and/or the second distance according to the thickness of the paper P. To this end, the thickness adjusting part R4 is positioned below the decurling part R3 and is provided so as to be detachable. For example, the thickness adjusting part R4 may be attached to and detached from the decurling part R3 by being fastened thereto with various methods such as screw fastening, fastening using a magnetic force, or the like. The thickness adjusting part R4 is detached from the decurling part R3 to prevent a pressure against the paper p from being excess when the paper p is thick. The thickness adjusting part R4 is attached to the lower side of the decurling part R3 to adjust the pressure of the decurling part R3 against to the paper p to increase when the paper p is thin. Specifically, when the thickness adjusting part R4 is mounted, the second distance is reduced to increase the pressure of the decurling part R3 against the paper p, and when the thickness adjusting part R4 is detached, the second distance is increased to reduce the pressure of the decurling part R3 against to the paper p. As described above, the pressure of the decurling part R3 may be adjusted corresponding to the thickness of the paper p by attaching and detaching the thickness adjusting part R4, so as to flexibly respond to various types of papers. By doing so, there is an effect in which the printing and decurling operation may be performed without being limited by the thickness of the paper p. The thickness adjusting part R4 may be similarly applied to all embodiments of the present invention.

Figure 13:
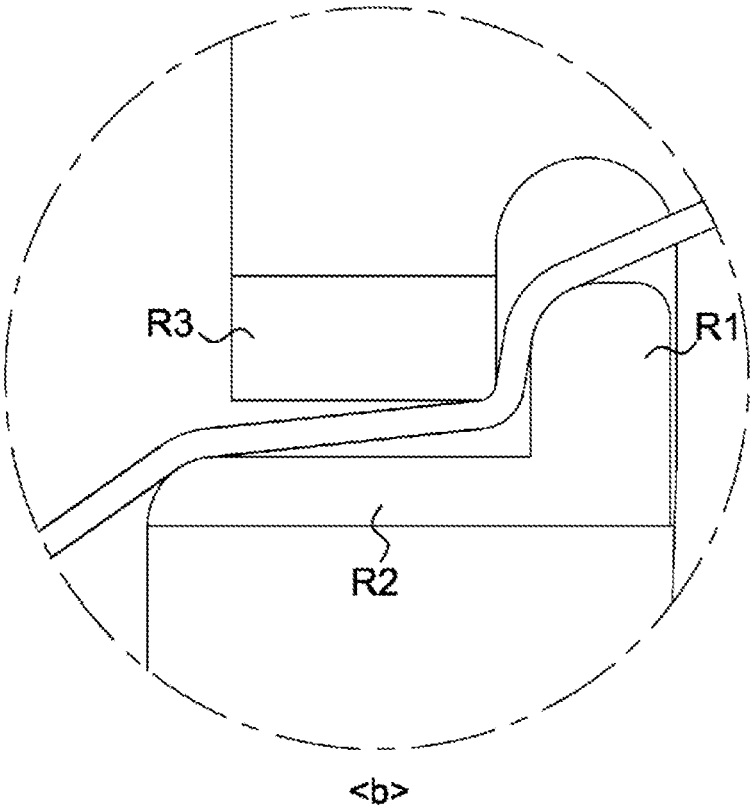
FIG. 13 is a view illustrating that the second distance is increased by detaching the thickness adjusting part R4 from the decurling part R3.

FIG. 13 is a view illustrating that the second distance is increased by detaching the thickness adjusting part R4 from the decurling part R3.

FIG. 13 shows that the second distance is adjusted, but the present invention is not limited thereto, and the thickness adjusting part R4 may be configured to adjust the first and/or second distance.

The embodiments of the present invention described above have been disclosed for the purpose of illustration, and various changes, modifications, and additions may be made within the spirit and scope of the invention by those skilled in the art. These modifications, changes, and additions are to be regarded as belonging to the scope of the claims of the present invention.

Since the above-described embodiments of the present invention may be variously substituted, modified, and changed by one of ordinary skill in the art without departing from the scope of the technical concept of the present invention, the present invention is not limited to the above-described embodiments and the attached drawings.

What is claimed is:

1. A printer for pulling out a paper wound in the form of a wound roll, comprising:
- a cartridge configured to accommodate the paper;
- a housing in which the cartridge is mounted; and
- a printing part configured to pull out the paper, wherein
- the housing includes a cover configured to open and close an upper surface of the housing,
- the cover includes a decurling part formed thereon, the decurling part comes into surface-contact with the paper on an upper side of the paper in the process of pulling out the paper when the cover closes the upper surface of the housing,
- the cartridge includes a first guide part formed thereon, the first guide part comes into surface-contact with the paper on a lower side of the paper in the process of pulling out the paper,
- the housing includes a second guide part formed thereon, the second guide part comes into surface-contact with the paper on the lower side of the paper in the process of pulling out the paper,
- the first guide part and the second guide part are formed to have a step with respect to each other, and
- the paper is decurled by passing through a space between the decurling part and the step.

2. The printer of claim 1, wherein the decurling part is positioned in a space formed by the step between the first guide part and the second guide part when the cover closes the upper surface of the housing.

3. The printer of claim 1, wherein the decurling part includes a detachable thickness adjusting part such that a pressure of the decurling part against to the paper is adjusted by modifying a thickness of the decurling part.

4. The printer of claim 1, wherein at least one of the first guide part, the second guide part, or the decurling part has a corner in contact with the paper, and the corner has a curvature radius.

5. The printer of claim 1, wherein the first guide part, the second guide part, and the decurling part have corners in surface-contact with the paper, and a curvature radius of a corner of the decurling part is smaller than a curvature radius of corners of the first guide part and the second guide part.

6. The printer of claim 1, wherein the first guide part, the second guide part, and the decurling part have corners in surface-contact with the paper, and corners of the first guide part and the second guide part have a curvature radius, and a corner of the decurling part has a right angle.

7. A printer for pulling out a paper wound in the form of a wound roll, comprising:
- a cartridge configured to accommodate the paper;
- a housing in which the cartridge is mounted; and
- a printing part configured to pull out the paper,
- wherein the cartridge includes a decurling part formed thereon, the decurling part comes into surface-contact with the paper on an upper side of the paper in the process of pulling out the paper,
- the housing includes a first guide part and a second guide part formed thereon, the first guide part and the second guide part come into surface-contact with the paper on a lower side of the paper in the process of pulling out the paper,
- the first guide part and the second guide part are formed to have a step with respect to each other, and
- the paper is decurled by passing through a space between the decurling part and the step.

8. The printer of claim 7, wherein the printing part pulls out the paper so that the paper is bent at the second guide part with an included angle of 120 degrees or more.

9. The printer of claim 7, wherein the decurling part is positioned in a space formed by the step between the first guide part and the second guide part when the cartridge is mounted in the housing.

10. The printer of claim 7, wherein the decurling part includes a detachable thickness adjusting part such that a pressure of the decurling part against to the paper is adjusted by modifying a thickness of the decurling part.

11. The printer of claim 7, wherein at least one of the first guide part, the second guide part, or the decurling part has a corner in contact with the paper, and the corner has a curvature radius.

12. The printer of claim 7, wherein the first guide part, the second guide part, and the decurling part have corners in surface-contact with the paper, and a curvature radius of a corner of the decurling part is smaller than a curvature radius of corners of the first guide part and the second guide part.

13. The printer of claim 7, wherein the first guide part, the second guide part, and the decurling part have corners in surface-contact with the paper, and corners of the first guide part and the second guide part have a curvature radius, and a corner of the decurling part has a right angle.

14. A printer for pulling out a paper wound in the form of a wound roll, comprising:
- a cartridge configured to accommodate the paper;
- a housing in which the cartridge is mounted; and
- a printing part configured to pull out the paper, wherein
- the housing includes a cover configured to open and close an upper surface of the housing, the cover includes a decurling part formed thereon, the decurling part comes into surface-contact with the paper on an upper side of the paper in the process of pulling out the paper when the cover closes the upper surface of the housing, the housing includes a first guide part and a second guide part formed thereon, the first guide part and the second guide part come into surface-contact with the paper on a lower side of the paper in the process of pulling out the paper, the first guide part and the second guide part are formed to have a step with respect to each other, and the paper is decurled by passing through a space between the decurling part and the step.

15. The printer of claim 14, wherein the decurling part is positioned in a space formed by the step between the first guide part and the second guide part when the cover closes the upper surface of the housing.

16. The printer of claim 14, wherein the decurling part includes a detachable thickness adjusting part such that a pressure of the decurling part against to the paper is adjusted by modifying a thickness of the decurling part.

17. The printer of claim 14, wherein at least one of the first guide part, the second guide part, or the decurling part has a corner in contact with the paper, and the corner has a curvature radius.

18. The printer of claim 14, wherein the first guide part, the second guide part, and the decurling part have corners in surface-contact with the paper, and a curvature radius of a corner of the decurling part is smaller than a curvature radius of corners of the first guide part and the second guide part.

19. The printer of claim 14, wherein the first guide part, the second guide part, and the decurling part have corners in surface-contact with the paper, and corners of the first guide part and the second guide part have a curvature radius, and a corner of the decurling part has a right angle.

* * * * *